US005456304A

United States Patent [19]

Colson et al.

[11] Patent Number: 5,456,304

[45] Date of Patent: Oct. 10, 1995

[54] APPARATUS FOR MOUNTING A RETRACTABLE COVERING FOR AN ARCHITECTURAL OPENING

[75] Inventors: Wendell B. Colson, Boulder; Terry L. Akins, Louisville, both of Colo.

[73] Assignee: Hunter Douglas Inc., Upper Saddle River, N.J.

[21] Appl. No.: 921,021

[22] Filed: Jul. 29, 1992

Related U.S. Application Data

[63] Continuation-in-part of Ser. No. 717,284, Jun. 20, 1991, Pat. No. 5,320,154, which is a continuation-in-part of Ser. No. 626,916, Dec. 13, 1990, abandoned.

[51] Int. Cl.[6] ..... A47H 13/00

[52] U.S. Cl. ..... 160/121.1; 160/133; 160/383; 160/399

[58] Field of Search ..... 160/121.1, 133, 160/383, 399

[56] References Cited

U.S. PATENT DOCUMENTS

| | | | |
|---|---|---|---|
| Re. 30,254 | 4/1980 | Rasmussen . | |
| 286,027 | 10/1883 | Lobdell . | |
| 536,302 | 3/1895 | Squier | 160/399 |
| 642,041 | 1/1900 | Guntner et al. | 160/399 |
| 1,553,862 | 9/1925 | Kirsch | 160/399 X |
| 1,776,119 | 9/1930 | Johnson | 160/383 X |
| 1,937,342 | 11/1933 | Higbie . | |
| 1,958,695 | 5/1934 | Claus . | |
| 2,022,807 | 12/1935 | Hagerty | 160/399 X |
| 2,029,675 | 2/1936 | Schlamp . | |
| 2,110,145 | 3/1938 | Loehr . | |
| 2,140,049 | 12/1938 | Grauel . | |
| 2,267,869 | 12/1941 | Loehr . | |
| 2,834,412 | 5/1958 | Velke . | |
| 2,865,446 | 12/1958 | Cole . | |
| 2,914,122 | 11/1959 | Pinto . | |
| 3,142,333 | 7/1964 | Kummerman et al. | 160/133 X |
| 3,265,116 | 8/1966 | Guffan | 160/121.1 |
| 3,292,685 | 12/1966 | Clark . | |
| 3,371,702 | 3/1968 | Keegan et al. . | |
| 3,384,519 | 5/1968 | Froget . | |
| 3,421,276 | 1/1969 | La Barge . | |
| 3,661,665 | 5/1972 | Froget . | |
| 3,701,376 | 10/1972 | Froget . | |
| 3,783,931 | 1/1974 | Assael . | |
| 4,019,554 | 4/1977 | Rasmussen . | |
| 4,039,019 | 8/1977 | Hopper . | |
| 4,182,088 | 1/1980 | Ball . | |
| 4,194,550 | 3/1980 | Hopper . | |
| 4,258,778 | 3/1981 | Upton et al. | 160/383 |
| 4,344,474 | 8/1982 | Berman . | |
| 4,386,454 | 6/1983 | Chodosh . | |
| 4,519,434 | 5/1985 | Forquer . | |
| 4,694,543 | 9/1987 | Conley . | |
| 4,799,299 | 1/1989 | Campbell . | |
| 4,921,900 | 4/1990 | Yeamans . | |
| 5,117,893 | 6/1992 | Morrison . | |

FOREIGN PATENT DOCUMENTS

| | | |
|---|---|---|
| 249985 | of 1961 | Australia . |
| 29442 | of 0000 | European Pat. Off. . |
| 0430882A1 | 11/1990 | European Pat. Off. . |
| 319458 | 3/1902 | France . |
| 847779 | 10/1939 | France . |

(List continued on next page.)

*Primary Examiner*—Ramon O. Ramirez
*Assistant Examiner*—Derek J. Berger
*Attorney, Agent, or Firm*—Gary M. Polumbus; Holland & Hart

[57] ABSTRACT

An assembly consisting of a covering including a pair of parallel fabric sheets interconnected by a series of spaced vanes forming joints with the sheets along their marginal edges. A roller is inserted into the space defined between a pair of adjacent vanes and a clip is resiliently mounted on and cooperates with the roller to capture a portion of at least one of the sheets and one of the pair of vanes, The roller and clip define collectively a roll-up surface for the covering that defines a base circle and has at least three projections projecting outwardly from the base circle to create a plurality of unobstructed recesses to receive portions of the covering when rolled up around the roller and clip.

8 Claims, 3 Drawing Sheets

FOREIGN PATENT DOCUMENTS

| | | |
|---|---|---|
| 1166398 | of 1957 | France . |
| 1309194 | of 1961 | France . |
| 1364674 | of 1963 | France . |
| 1321456 | 2/1963 | France . |
| 1373515 | of 1964 | France . |
| 1381472 | of 1966 | France . |
| 1480262 | of 1966 | France . |
| 1465261 | of 1966 | France . |
| 1526507 | of 1967 | France . |
| 1585159 | of 1968 | France . |
| 2217518 | 6/1974 | France . |
| 2398170 | of 1979 | France . |
| 2735654 | of 0000 | Germany . |
| 1942674 | of 0000 | Germany . |
| 122088 | 4/1900 | Germany . |
| 382758 | of 1923 | Germany . |
| 684202 | of 1939 | Germany . |
| 1241361 | of 1967 | Germany . |
| 7008554 | of 1970 | Germany . |
| 2304809 | 8/1974 | Germany . |
| 2923233 | of 1980 | Germany . |
| 2936811 | of 1981 | Germany . |
| 3525515 | of 1987 | Germany . |
| 8810922 | 12/1988 | Germany . |
| 8906284 | 9/1989 | Germany . |
| 7805464 | of 1978 | Netherlands . |
| 476482 | of 0000 | Switzerland . |
| 331432 | of 1958 | Switzerland . |
| 423207 | of 1967 | Switzerland . |
| 494338 | of 1970 | Switzerland . |
| 979683 | 1/1965 | United Kingdom . |
| 1228677 | of 1971 | United Kingdom . |
| WO8002712 | of 1971 | WIPO . |

APPARATUS FOR MOUNTING A RETRACTABLE COVERING FOR AN ARCHITECTURAL OPENING

CROSS-REFERENCE TO RELATED APPLICATION

This application is a continuation-in-part of application Ser. No. 07/717,284, filed Jun. 20, 1991, now U.S. Pat. No. 5,320,154, which is a continuation-in-part of application Ser. No. 07/626,916, filed Dec. 13, 1990, now abandoned.

FIELD OF THE INVENTION

The present invention relates to an apparatus for mounting a retractable covering device useful for covering various architectural openings and as retractable space dividers. More particularly, the present invention relates to roller type deployment and mounting of light control window coverings having first and second parallel sheets and a plurality of transverse vanes connecting said sheets.

BACKGROUND OF THE INVENTION

Fabric light control window coverings are known in the art, an illustrative disclosure is U.S. Pat. No. 3,384,519 to Froget. Froget discloses a shade having two parallel mesh fabric sheets with a number of movable vanes disposed between the sheets. The parallel fabric sheets are movable relative to each other in order to control the angle of the blades. This shade is attached to a typical cylindrical roller shade head roller for rolling up the shade and controlling the angle of the blades. Similar disclosures are found in U.S. Pat. Nos. 2,029,675 and 2,140,049 and French patent No. 1,309,194. German patent No. 382,758 discloses a similar window covering, however instead of a cylindrical head roller an elliptical head roller is provided.

As illustrated in the above disclosures, such a window covering is generally a sandwich of three layers which are attached together at various points. As the sandwich rolls around a roller, the layer around the outside must travel a greater distance than the inner layer. The thicker the sandwich is, and particularly the blades, the more pronounced this effect becomes. Thus, in practice with known deployment means, as the window covering rolls up around the head roller, the outer layer must stretch or the inner layer must buckle in order to accommodate the different distances that the two layers follow around the roller. Stretchy fabrics are undesirable because the blades would be unaligned in the lowered position and if non-stretchy fabrics are used the inner layer will form buckles, which can cause a permanent wrinkle or crease to develop in the fabric over time. This is because as the window covering is wrapped tightly around the roller there is a constant pressure compressing the buckle in the inner layer between the other layers and against the roller itself. In addition to an unattractive appearance, the buckles also create a high point on the roller which can occur unevenly and cause the window covering to roll up unevenly or skew to one side of the roller.

U.S. Pat. No. 4,344,474 to Berman discloses an insulated shade which includes a number of layers wrapped around a cylindrical head roller. While not a light control shade, the layers of the Berman shade appear to be connected together by bushings. Berman has recognized that the different layers will roll up at different rates and has provided journal plates having slotted holes to retain the bushings. This allows relative sliding between the bushings in an attempt to compensate for the different roll up rates of the different layers.

In roller shades in general it is important that the fabric be fastened to the head roller at an exact right angle to the cut edges of the fabric. This is to insure that the fabric rolls up straight along the head roller without skewing to the left or right. The curtain roller disclosed in U.S. Pat. No. 286,027 to Lobdell is an attempt to solve this problem in typical single sheet roller shades. Two slats are provided, one having tacks extending outward therefrom. The slot with tacks is positioned at the top of the curtain, at a right angle to the longitudinal line of direction of the curtain. The tacks are pressed through the curtain fabric and the second slat is pressed on to the tacks on the opposite side of the curtain. The slats attached to the curtain are slid into a complimentary groove in the roller. This construction has disadvantages in not being self aligning and requiring that the slats be placed very exactly on the curtain fabric.

A further drawback of known deployment systems for this type of window covering is that they may be rolled up the wrong way. This would result in the blades being folded back over themselves at the point of attachment to the fabric sides giving rise to at least two difficulties. First, the bulk of the window covering when rolled up would be increased. Second, if the blades were initially made without creases at the attachment points, creases would be formed due to the folding over.

A more recent proposal has been made, see copending application Ser. No. 07/717,284, filed Jun. 20, 1991, for rolling and unrolling a layered light control covering device which does not create permanent creases or wrinkles in the layers and also allows for rolling without skewing of the covering device to the left or right. A roller is proposed that has a discontinuous surface formed by outwardly extending lobes or rounded projections which define recesses to receive buckles formed in the inner layer of the covering device as it is rolled on to the roller. Thus, the buckles are not pressed against the roller to form permanent creases or wrinkles. Also the buckles do not create high spots which would cause the covering device to skew to the left or right when rolled onto the roller. The proposed means of attachment for such a covering device to the head roller, which ensures alignment of the covering device with the head roller, includes providing a recess in the roller parallel to the roller axis. The line of attachment between the top vane and one sheer fabric is received in the recess and held in place by a holding means, which includes a triangular channel in the head roller which receives a wedge-shaped filler strip. The recess just described is formed by the vertex of the triangular channel. The wedge-shape of the filler strip cooperates with one of the sheer fabrics and the top vane of the covering device to force the window covering along the line of attachment between the vane and fabric into the triangular channel, thus ensuring proper alignment. A second channel of circular cross section is provided for attaching the opposite sheer fabric and is designed to tension the first vane against the wedge-shaped filler strip, thus, further insuring proper alignment. The circular channel has an opening which is less in the inside diameter of the channel. The second sheer fabric is wrapped around a resilient tubular clamping member which is forced through the opening into the circular channel. Alternatively, the second channel may be V-shaped and the second sheer fabric is secured to a complementary V-strip and inserted in the V-shaped channel such that the second sheer fabric is firmly held between the V-shaped channel and the V-strip.

SUMMARY OF THE INVENTION

The present invention provides a unique head roller or head rail design that enables coverings of the type described to be hung in a roller deployment system that allows roll-up in an efficient and efficacious manner without danger of stress, creasing or impairment to the aesthetic appearance of the covering. Further, the attachment of the fabric covering to the roller is effected in a more secure and even way.

The foregoing is accomplished by using a unique roller of special geometry that coacts with a unique clip of special geometry to make a simple connection or mounting for the front and rear sheers of the covering which the combination of roller and clip provides a desirable peripheral geometry to create three equidistant projections to accommodate the three layered covering upon roll-up in a pleasing manner that avoids stress and creasing.

Accordingly, the principal objects of the present invention are to provide a novel head roller-clip combination which also combines with a light control covering of the type described to form a novel assembly.

Other objects and advantages of the present invention will become evident from the following description of a preferred embodiment taken in conjunction with the appended drawings.

DETAILED DESCRIPTION OF PREFERRED EMBODIMENT

Figure 1:
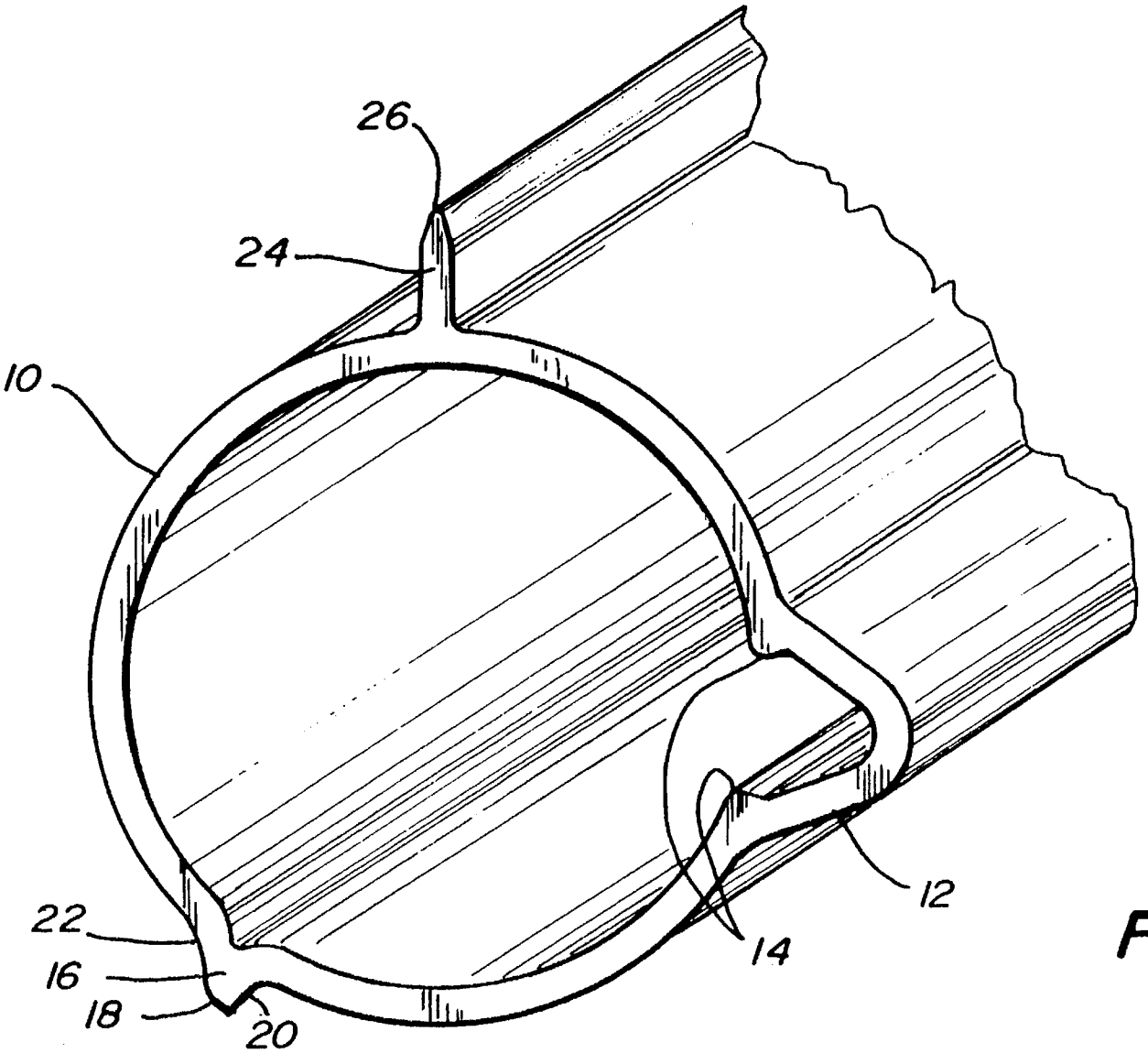
FIG. 1 is a perspective view of the novel roller of the present invention.
Figure 2:
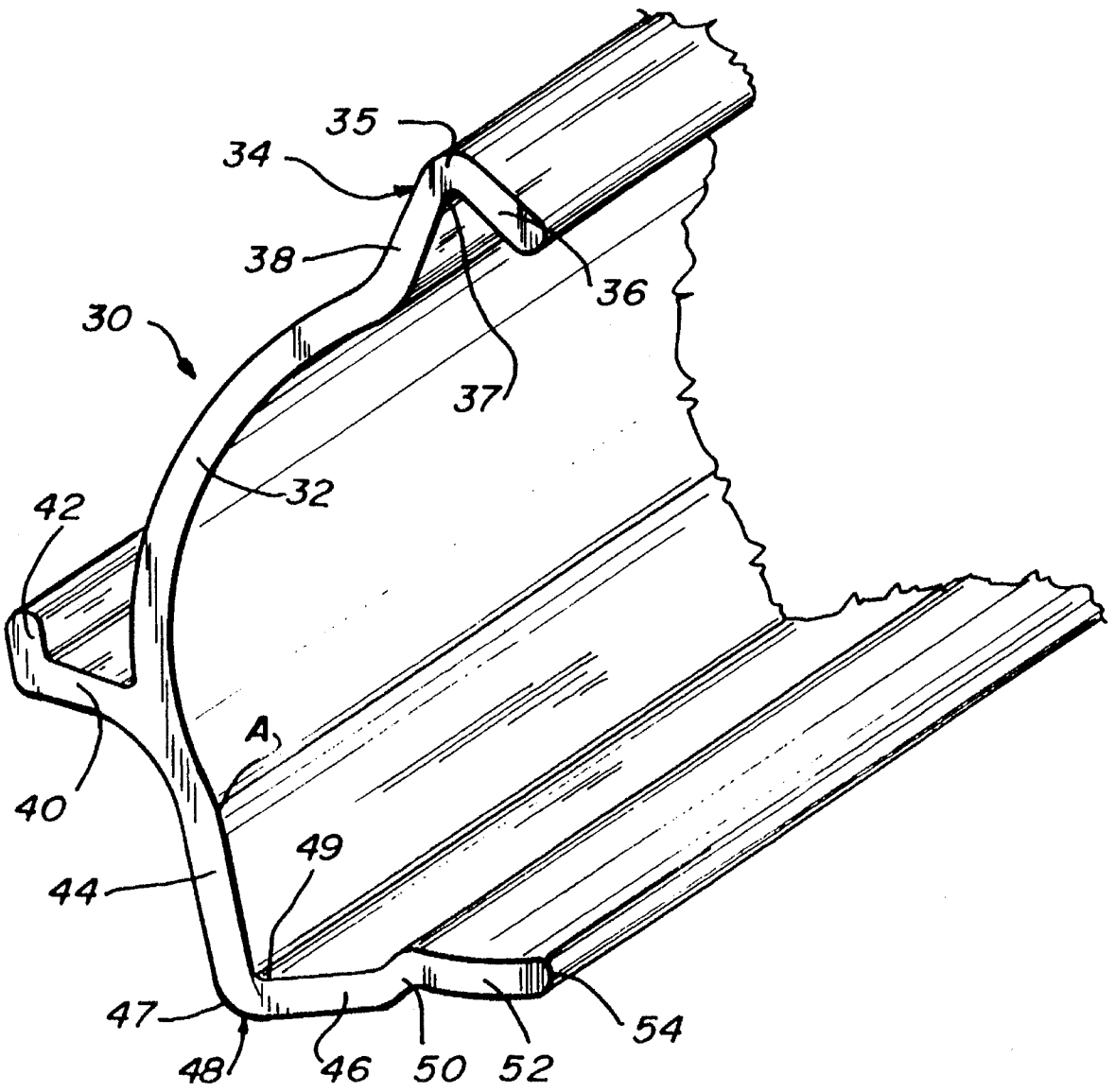
FIG. 2 is a perspective view of the novel clip of the present invention.
Figure 3:
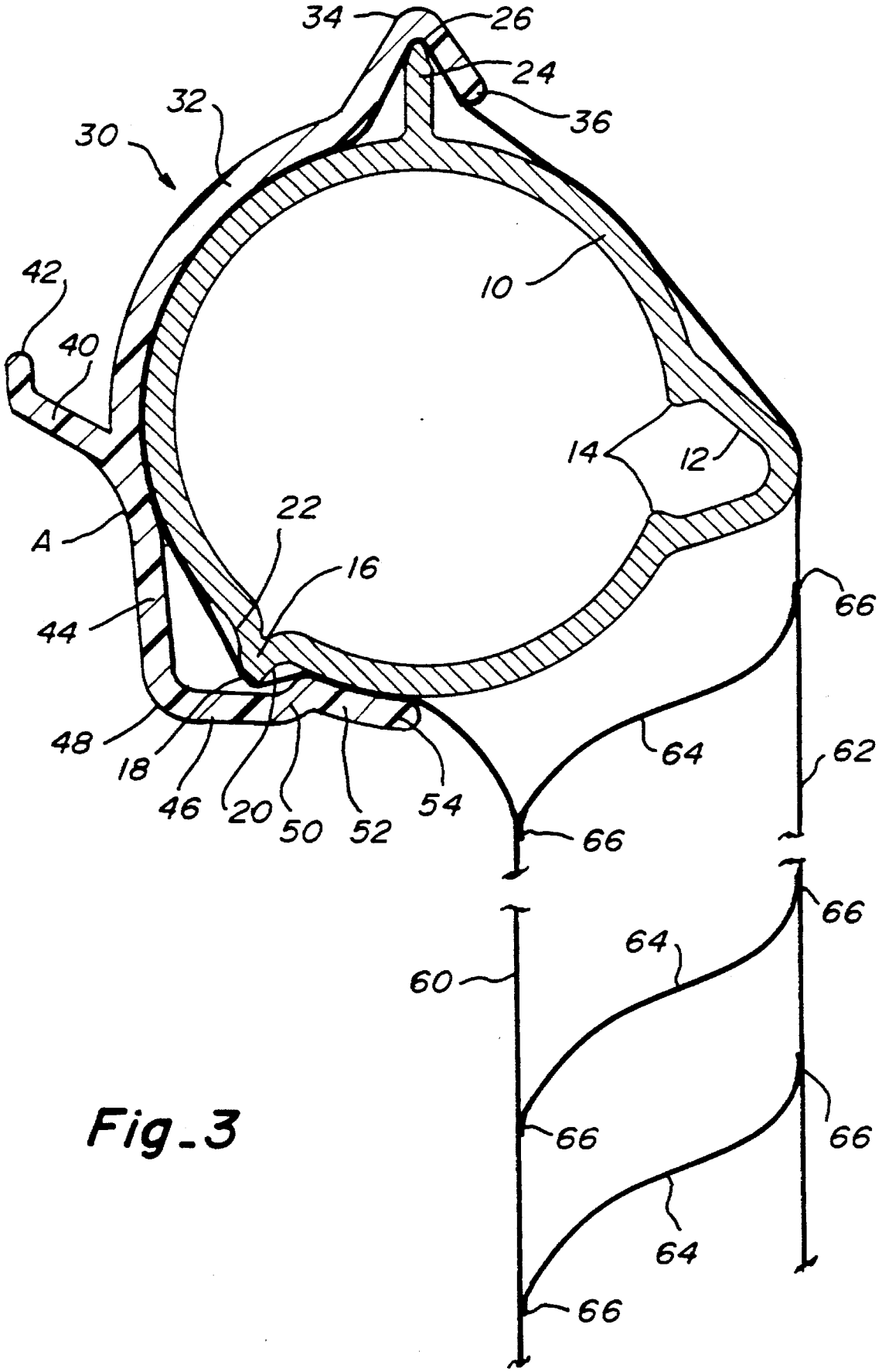
FIG. 3 is a view in section showing the assembly of roller with clip mounted thereon holding a light control window covering.

FIGS. 1–3 show the present invention in detail. A roller 10, shown in FIG. 1, is made of extruded aluminum or the like and is tubular in form having three equally peripherally spaced projections, that is, spaced about 120° apart. A first projection 12 projects outwardly from the base circle of the tube 10 about 20– 25% of the diameter of the base circle and is in the form of an isosceles triangle with sides or surfaces sloping or converging to an apex defining an interior angle of about 60°. On the inside of the tube 10 at the base of projection 12 is a pair of opposed rounded modules 14. As shown in FIGS. 1 and 3, a second projection or rib 16 extends outwardly from the outer surface of a base circle of the tube 10 a short distance and defines a radial surface or side 20, a sloping surface or side 22, and an outer surface or edge 18 which meets the radial surface 20 generally at a right angle and meets the sloping surface 22 at a shallow acute angle. The outer surface 18 thus lies in a plane generally tangentially parallel to the tube surface or base circle. The third projection or rib 24 is blade-like with a tapered or gabled and rounded free end or edge 26 and projects radially about 15–18% of the diameter of the base circle of the tube 10. The projection 12 lies between the other two projections 16 and 24.

A clip 30, shown in FIG. 2, is made of a stiff but resilient material such as ABS and essentially describes an arc of slightly less than 180° about 130°–150°. The central section 32 of clip 30 is circular and extends from end projection 34 to point A, an arc of about 90°. The radius of section 32 matches the radius of the base circle of tube 10 so that section 32 will overlie tube 10. End projection or rib 34 is an inverted V-shape having a free leg 36 and a leg 38 attached to section 32. Projection 34 projects an angle of about 60° and as shown in FIG. 2 defines an outwardly directed rounded vertex 35 and an inwardly directed V-shaped channel 37. Projecting from section 32 near point A at an acute angle is a plate-like freestanding section 40 terminating in a bent free end 42 that is pointing toward projection 34. This projection 40, 42 corresponds with projection 116 shown in FIGS. 14*a–c* of the aforementioned application Ser. No. 07/717,284 in that it may cooperate with a top catch mechanism as described in said application. Connected to section 32 at point A is an L-shaped section consisting of a leg 44 and short leg 46 connected by a rounded knee section 48 and defining a longitudinally extending rib having an outwardly directed rounded vertex 47 and an inwardly directed V-shaped channel 49. Both legs 44 and 46 extend outside the radius of section 32 for a short distance. The end 50 of leg 44 curves inwardly and terminates at the radius of section 32 and is joined to a termination section 52 having free end 54 that is a radial continuation of section 32. Knee section 48 lies about 120° from projection 34.

FIG. 3 shows the tube 10 mounted in a window covering which is held on by clip 30. Both the roller 10 and clip 30 extend for the width of the covering, but it would be possible to use a series of spaced shorter clips. The window covering is described in detail in copending application Ser. No. 07/717,284, filed Jun. 20, 1991, which description is herein incorporated by reference. Essentially, the covering consists of a front sheer 60 and rear sheet 62 interconnected by vanes 64 by means of adhesive bonding joints 66 formed between the edges of vanes 64 and sheers 60 and 62.

The assembly is made by placing roller 10 through the covering, beneath the top vane 64 and placing free edge or end 26 of blade 24 into the joint 66 formed between the rear sheet 62 and vane 64. The vane 64 and front sheer 60 are wrapped counterclockwise around roller 10, as viewed in FIG. 3, and the rear sheer 62 drapes around roller 10 clockwise, as viewed in FIG. 3, falling over projection 12. Clip 30 is then applied to roller 10 by placing projection 34 over blade 24 to trap the joint 66 (vane 64 and rear sheer 62) in the Vee which registers with the taper of free edge 26. The clip 30 wraps around the roller 10, counterclockwise, as viewed in FIG. 3, capturing the vane 64 and front sheer 60 between section 32 and roller 10. Projection 16 or roller 10 serves as a snap catch over which inwardly curving section 50 must resiliently deflect to pass. Section 50 catches against side 20 to detachably hold clip 30 on tube 10. The termination section 52 captures the joint 66 between vane 64 and front sheer 60. As can be clearly seen from FIG. 3, when the clip 30 is attached to the roller 10 to hold the window covering securely thereon, a roller assembly is provided having three circumferentially spaced projections or ribs each of which is formed by outwardly extending converging sloping surfaces and a rounded longitudinally extending outer apex or edge.

In the position shown in FIG. 3, the vanes 64 are approximately half closed. If the assembly is rotated clockwise about 90° (as viewed in FIG. 3), the vanes would be fully opened, that is, reasonably horizontal. If the assembly is rotated counterclockwise about 60°–90° (as viewed in FIG. 3), the vanes 64 would first close. Continued counterclockwise rotation would roll up the covering where it would be readily accommodated in the various spaces between the exposed projections 40, 46, 34 and 12. Depending upon the hardware associated with the assembly, it could readily be made to roll up in both directions.

Although the invention has been shown and described with reference to a preferred embodiment, changes may be made which do not depart from the teachings hereof. Such are deemed to fall within the purview of the invention as claimed.

What is claimed is:

1. An assembly comprising a covering including a pair of parallel fabric sheets interconnected by a series of spaced vanes forming joints with the sheets along their marginal edges, a roller inserted into the space defined between a pair of adjacent vanes and a clip resiliently mounted on and cooperating with said roller to capture at least a portion of at least one of the sheets and at least a portion of the pair of vanes, said roller and said clip collectively defining a roll-up surface for said covering that defines a base circle and has at least three projections projecting outwardly from the base circle to create a plurality of unobstructed recesses to receive portions of the covering when rolled up around said roller and clip.

2. An assembly as claimed in claim 1, wherein said roller defines a radial projection that engages said covering in one of said joints.

3. An assembly as claimed in claim 2, wherein said radial projection engages the covering in a joint formed between a vane and the sheet constituting the rear sheet of the covering.

4. An assembly as claimed in claim 1, wherein said roller defines three projections peripherally spaced about 120° apart.

5. An assembly as claimed in claim 4, wherein a first projection is a radial blade and a second projection provides a catch.

6. An assembly as claimed in claim 5, wherein the clip engages the roller at the first and second projections.

7. For use with a flexible light control material formed by a pair of spaced parallel fabric sheets interconnected by a plurality of spaced parallel vanes the longitudinal marginal edges of which form joints with said sheets, said vanes further defining cells between said sheets, a roller and clip assembly for mounting said material when said roller is inserted into one of said cells and said clip is resiliently engaged with said roller to secure said material to said roller by engaging at least a portion of at least one of the sheets and at least one of said vanes, said roller and clip assembly comprising a cylindrical roller tube defining an outer surface, a longitudinally-extending rib integral with said tube and extending radially outwardly from said surface and defining an outwardly extending radial surface, a blade-like rib extending radially outwardly from said surface spaced from said radial surface rib and having a tapered and rounded free edge, and a longitudinally extending rib spaced from said ribs and defining sloping surfaces extending outwardly from said outer surface in mutually converging relationship with respect to each other, an elongated resilient transversely arcuate clip having opposed longitudinal edges and defining a convex outer surface and a concave inner surface, a radially outwardly extending longitudinal V-shaped rib on said clip adjacent one edge thereof and defining a first inwardly directed V-shaped channel, and an outwardly extending longitudinal V-shaped rib adjacent the other edge of said clip and defining a second inwardly directed V-shaped channel having a radially inwardly extending surface thereon, said V-shaped clip channel engaging over said blade-like rib, and said radially inwardly extending clip surface engaging said outwardly extending radial surface on said roller, said clip being securely engaged with said roller to retain said light control material therebetween, said clip and said roller together forming a cylindrical body supporting said material and said spaced outwardly extending V-shaped ribs projecting outwardly from said body and clip and defining therewith a plurality of unobstructed recesses for receiving portions of said material when the same is rolled up around said roller and clip.

8. A roller and clip assembly as defined in claim 7, wherein said clip further comprises a longitudinal plate extending outwardly from said arcuate body convex surface and defining with said surface an acute angle opening towards said one edge and a longitudinally extending lip on the outer edge of said plate, said lip extending toward said one edge.

* * * * *